US005322201A

United States Patent [19]

Garr

[11] Patent Number: 5,322,201

[45] Date of Patent: Jun. 21, 1994

[54] WRAPPING TABLE ASSEMBLY

[76] Inventor: Ernest J. Garr, P.O. Box 1226, Lafayette, Calif. 94549

[21] Appl. No.: 602,948

[22] Filed: Oct. 24, 1990

Related U.S. Application Data

[63] Continuation-in-part of Ser. No. 537,166, Jun. 11, 1990, abandoned, which is a continuation of Ser. No. 216,866, Jul. 8, 1988, abandoned, which is a continuation-in-part of Ser. No. 899,886, Aug. 25, 1986, abandoned, which is a continuation-in-part of Ser. No. 705,232, Feb. 25, 1985, abandoned, which is a continuation-in-part of Ser. No. 597,520, Apr. 6, 1984, abandoned, which is a continuation-in-part of Ser. No. 466,873, Feb. 16, 1983, abandoned, which is a continuation-in-part of Ser. No. 416,669, Sep. 10, 1982, abandoned.

[51] Int. Cl.[5] ..... B26F 3/02

[52] U.S. Cl. ..... 225/20; 225/47; 225/53; 225/77

[58] Field of Search ..... 225/53, 90, 20, 46, 225/47, 19, 48, 77, 79, 80, 49, 26; 83/649, 650; 242/55.2, 55.53, 68.7

[56] References Cited

U.S. PATENT DOCUMENTS

| | | | |
|---|---|---|---|
| 442,823 | 12/1890 | Palm | 83/650 X |
| 450,168 | 4/1891 | Loft | 225/90 X |
| 1,920,074 | 7/1933 | Gluck | 225/90 X |
| 2,125,736 | 8/1938 | Murray | 225/20 |
| 2,470,250 | 5/1949 | Kienle | 225/20 |
| 2,670,041 | 2/1954 | Krueger | 225/20 |
| 3,296,780 | 1/1967 | Revell | 242/55.2 X |
| 3,298,265 | 1/1967 | Millican et al. | 83/650 X |
| 3,698,548 | 10/1972 | Stenzel et al. | 242/55.53 X |
| 3,731,863 | 5/1973 | Nausedas | 225/20 |
| 3,739,964 | 6/1973 | Stine | 225/53 X |
| 3,771,700 | 11/1973 | Garr | 225/77 X |
| 3,989,175 | 11/1976 | Cherrin | 225/77 X |

FOREIGN PATENT DOCUMENTS

| | | | |
|---|---|---|---|
| 1276709 | 6/1972 | United Kingdom | 225/20 |

*Primary Examiner*—Rinaldi Rada

*Attorney, Agent, or Firm*—Flehr, Hohbach, Test, Albritton & Herbert

[57] ABSTRACT

Wrapping table assembly for use with a roll of wrapping material such as plastic film. The assembly includes a table top supported by a base on which the roll of material is rotatively mounted. A blade for cutting the film material extends along one side of the table top, and a retractable blade guard protects against accidental contact with the blade. The assembly can accommodate rolls of different widths.

18 Claims, 9 Drawing Sheets

WRAPPING TABLE ASSEMBLY

This is a continuation-in-part of Ser. No. 07/537,166, filed Jun. 11, 1990, now abandoned, which is a continuation of Ser. No. 07/216,866, filed Jul. 8, 1988, now abandoned, which is a continuation-in-part of Ser. No. 06/899,886, filed Aug. 25, 1986, now abandoned, which is a continuation-in-part of Ser. No. 06/705,232, filed Feb. 25, 1985, now U.S. Pat. No. 4,607,774, which is a continuation-in-part of Ser. No. 06/597,520, filed Apr. 6, 1984, now abandoned, which is a continuation-in-part of Ser. No. 06/466,873, filed Feb. 16, 1983, now abandoned, which is a continuation-in-part of Ser. No. 06/416,669, filed Sep. 10, 1982, now abandoned.

This invention pertains generally to the wrapping of objects such as food products, and more particularly to a wrapping table assembly for use with a roll of wrapping material.

Wrapping materials such as plastic film are commonly supplied in rolls and disposable dispensing boxes for use in the wrapping of food products and other objects. One example of a box for dispensing plastic wrapping film is found in U.S. Pat. No. 3,739,964. Once removed from the box, the film material is awkward to use, and U.S. Pat. No. 3,771,700 discloses a wrapping table attachment which mounts on a dispensing box to provide a convenient work surface on which objects can be wrapped. Nevertheless, the dispensing boxes have certain limitations and disadvantages.

Dispensing boxes are relatively expensive to manufacture, and wrapping materials can be supplied more economically in bulk or in cartons containing a plurality of rolls of the material. Dispensing boxes are commonly made of cardboard, and they deteriorate rapidly when subjected to moisture in a food handling environment. In addition, individual dispensing boxes present a problem of disposal when they are empty.

It is a general object of the invention to provide a new and improved wrapping table assembly for use with rolls of wrapping material.

Another object of the invention is to provide a wrapping table assembly of the above character which is convenient and easy to use.

Another object of the invention is to provide a wrapping table assembly of the above character which can be used with rolls of different widths.

Another object of the invention is to provide a wrapping table assembly of the above character which is portable and can be readily set up for use.

These and other objects are achieved in accordance with the invention by providing a wrapping table assembly having a generally planar top with a slotted opening therein and a cutting blade extending along one edge of the top. A retractable blade guard covers the cutting blade and can be displaced by the wrapping material to expose the blade. A roll of wrapping material is rotatively mounted in a base beneath the top, and the free end of the material passes through the opening in the top. Inclined guide members facilitate insertion of the roll and prevent it from being dislodged from the base as the material is withdrawn from the roll. A trap door prevents the free end of the material from falling back through the opening, and the table can be used with rolls of different widths.

Figure 10:
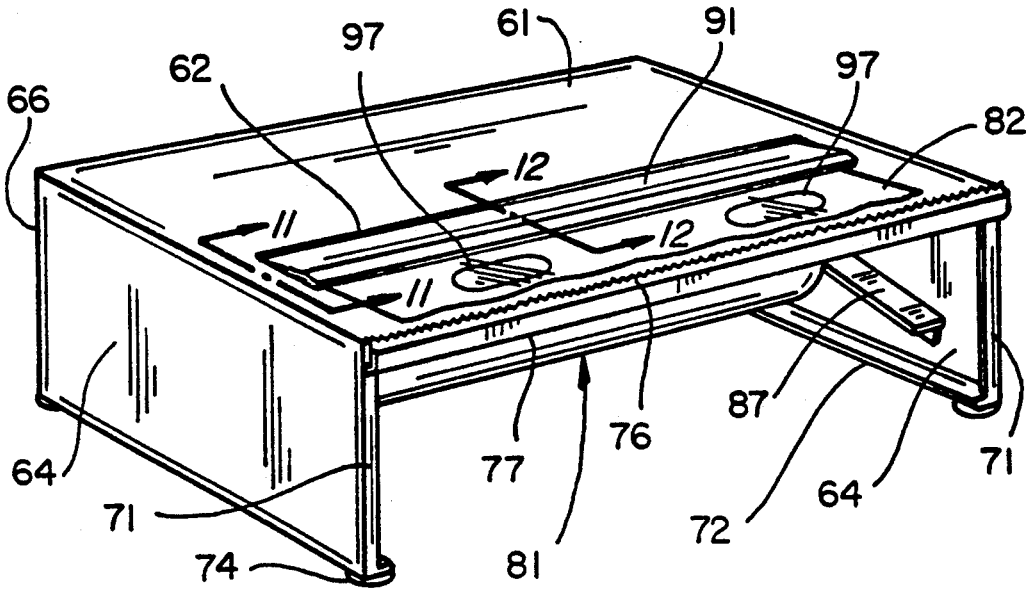
FIG. 10 is a perspective view of another embodiment of a wrapping table assembly according to the invention.
Figure 11:
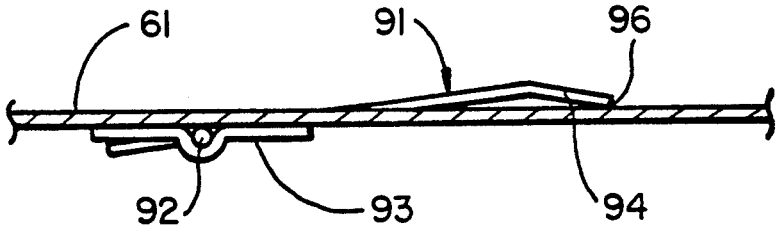
Figure 12:
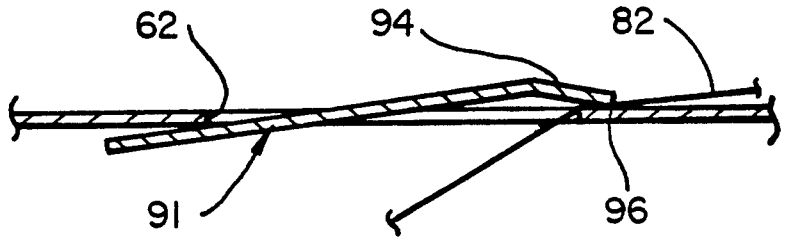

FIGS. 11 and 12 are enlarged fragmentary sectional views taken along lines 11—11 and 12—12 in FIG. 10.

Figure 13:
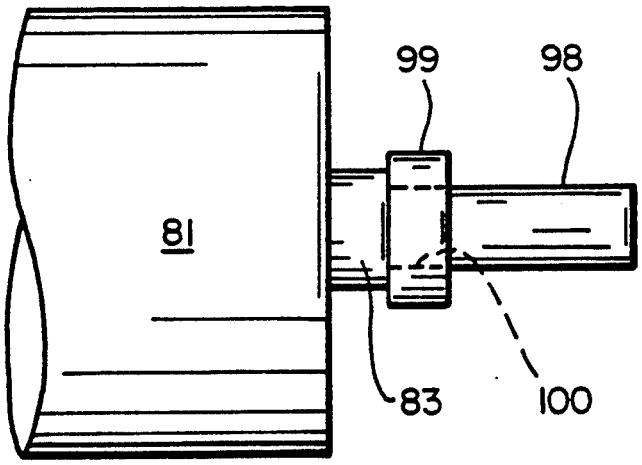

FIG. 13 is a fragmentary elevational view of a spindle and collar for holding rolls of wrapping material of different widths in the embodiment of FIG. 10.

Figure 14:
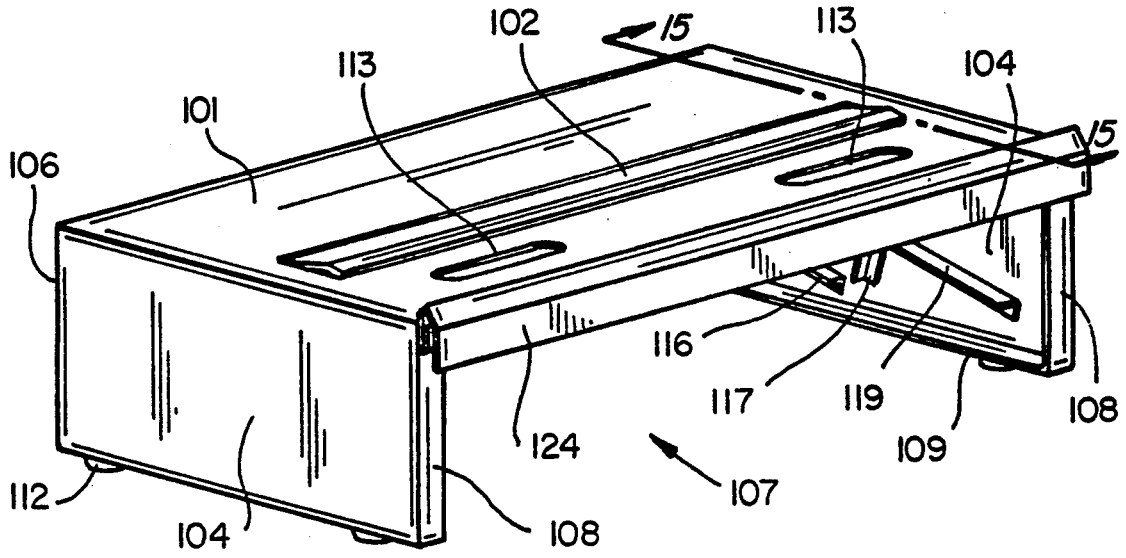

FIG. 14 is an isometric view of another embodiment of a wrapping table assembly according to the invention.

Figure 15:
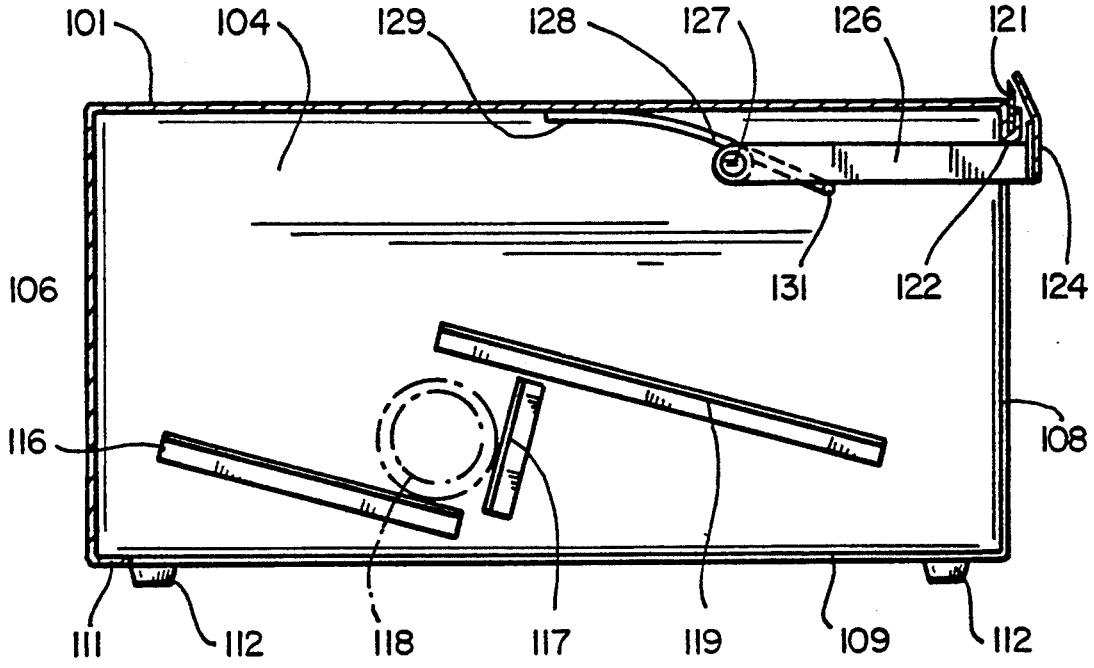

FIG. 15 is an enlarged sectional view taken along line 15—15 in FIG. 14.

Figure 16:
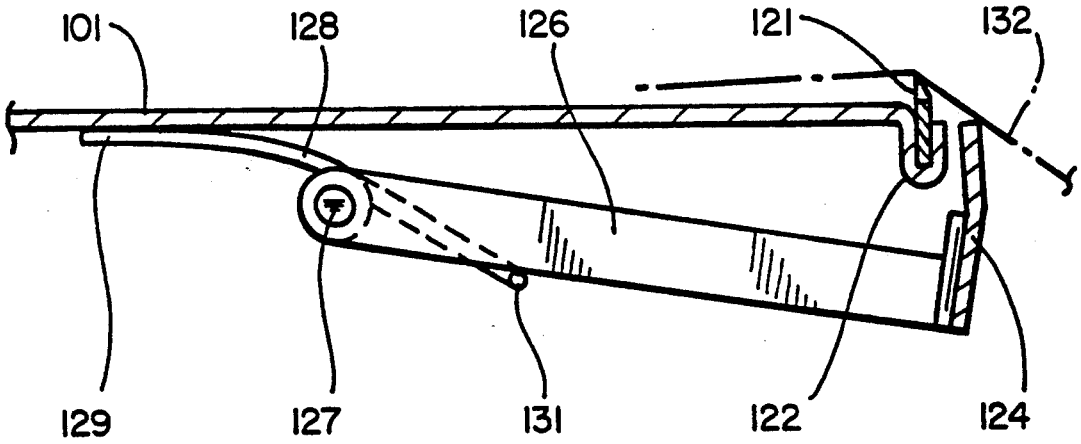

FIG. 16 is an enlarged fragmentary sectional view illustrating the blade guard in its lowered or retracted position.

Figure 17:
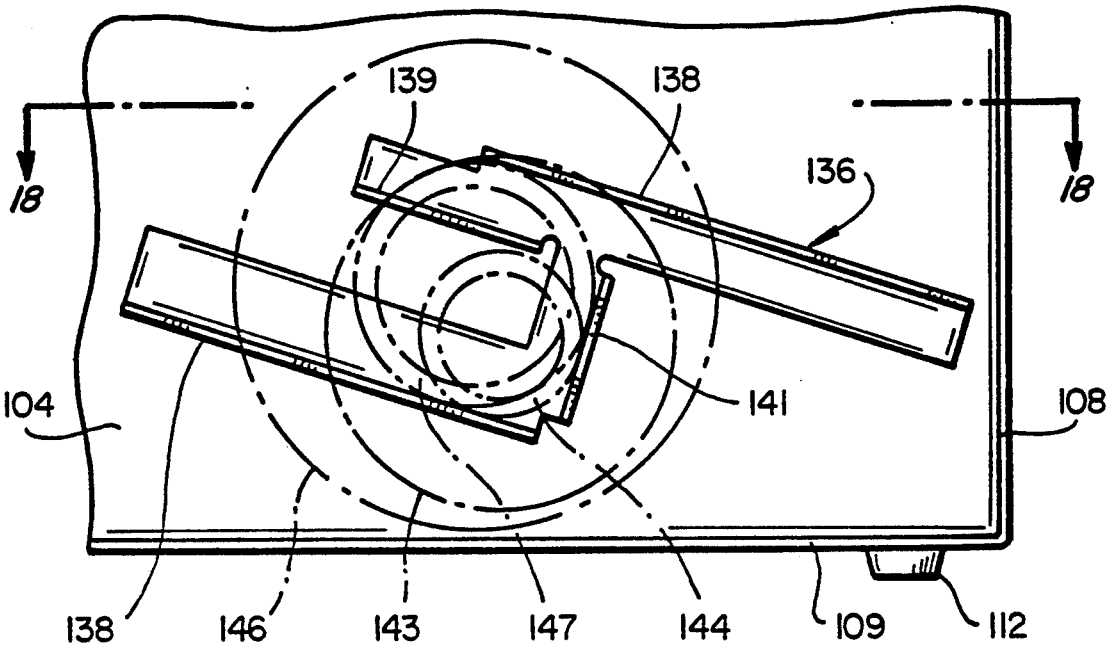

FIG. 17 is a fragmentary view, similar to FIG. 15, of another embodiment of a wrapping table assembly according to the invention.

Figure 18:
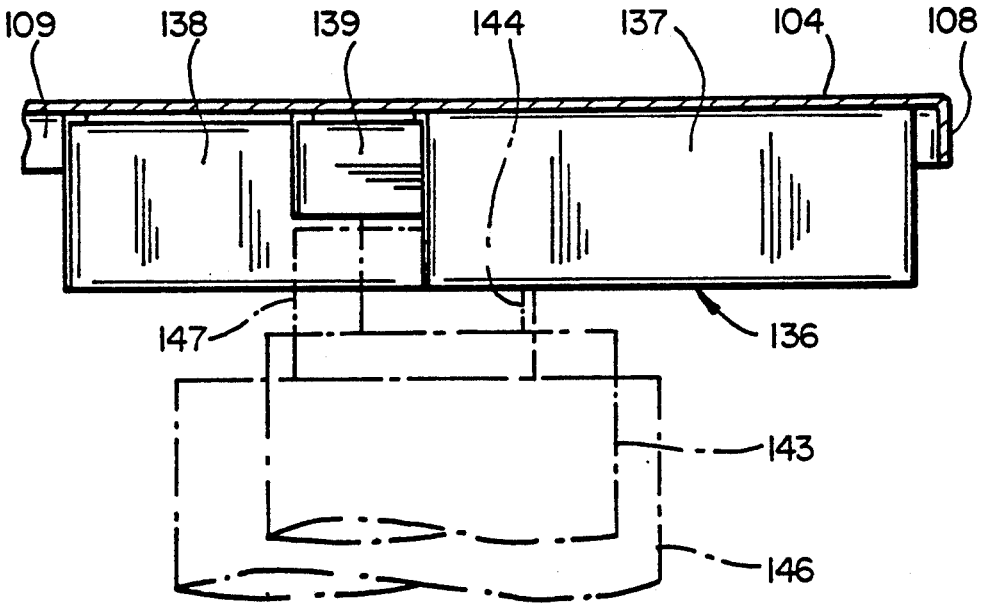

FIG. 18 is a cross-sectional view taken along line 18—18 in FIG. 17.

Figure 19:
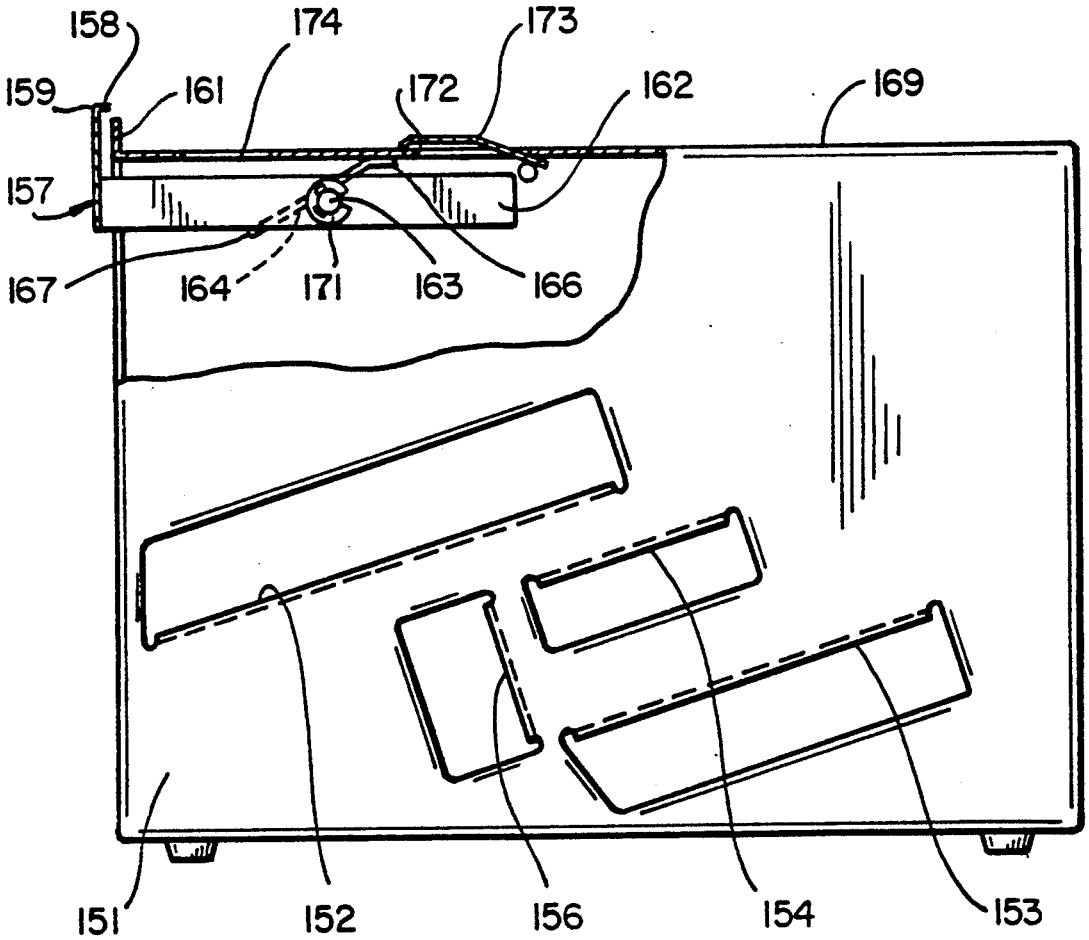

FIG. 19 is a side elevational view, partly broken away, of another embodiment of a wrapping table assembly according to the invention.

In the drawings, the wrapping table assembly is illustrated in connection with a roll 11 of wrapping material such as plastic film. The roll comprises an elongated sheet 12 of the material wrapped about a cylindrical core 13 which is hollow in the embodiment illustrated. The core is somewhat longer than the width of the material, and the end portions 14 of the core project from the edges of the rolled material. The table assembly comprises a generally L-shaped table member 16 having a rectangular, generally planar top 17 and a depending flange 18 which extends along the rear edge of the top. An elongated generally rectangular slotted opening 19 is formed in the table top in spaced parallel relation to flange 18. In one presently preferred embodiment, table member 16 is fabricated as a unitary structure of sheet metal such as stainless steel, but it can be fabricated from any other suitable material, if desired. The front and side edge portions of table top 17 are turned down and the side and bottom edge portions of flange 18 are turned forward to form flanges 21–24 which add rigidity to the structure.

The table assembly also includes a pair of legs 26 which cooperate with flange 18 to support table top 17 in a predetermined position, e.g., horizontal, above a supporting surface (not shown). Each of the legs comprises a generally rectangular upright panel 27 having an upper edge 28 upon which the lower surface of the table top rests. The legs are positioned generally beneath slotted opening 19, with the upright panels generally parallel to the side edges of the table top. The legs are fabricated of the same material as table member 16, with inwardly extending flanges 31, 32 along the side and bottom edges of panels 27.

Legs 26 each have a mounting tab 33 which projects upwardly from panel 27 through slotted opening 19 and interfits with table top 17 to hold the legs and the table top together and permit adjustment of the legs lengthwise of the opening to accommodate rolls of different widths. The upper portion of each mounting tab is turned over in an outward direction to form a horizontally extending flange 34 having a length somewhat greater than the width of opening 19. The lower surface of flange 34 is spaced above the upper edge 28 of panel 27 by a distance slightly greater than the thickness of table top 17, and flange 34 is positioned adjacent to the upper surface of the table top when the lower surface of the top rests on edge 28.

The width of flanges 34 is less than the width of opening 19, and the legs are installed by passing tabs 33 upwardly through the opening with flanges 34 extending lengthwise of the opening, then rotating the legs about a vertical axis until flanges 34 and upper edge 28 extend crosswise of the opening with the table top between them.

In the embodiment illustrated, rear flange 18 and the panel portions of legs 26 are all of equal height, and mounting feet 36 are mounted on the lower flanges 24, 32 of these elements for engagement with the supporting surface on which the assembly rests.

Means is provided for mounting the roll of wrapping material for rotation about an axis spaced beneath and generally parallel to slotted opening 19. This means includes circular openings 39 formed centrally in the panel portions 27 of the legs to rotatively receive the end portions 14 of roll core 13. The end portions extend through the openings, and end caps 41 are mounted on the end portions of the outer sides of the legs to retain the roll of material in position between the legs. The end caps are fabricated of plastic or other suitable material, with an inner diameter corresponding to the outer diameter of the roll core, whereby the caps are held on the core by friction and can be removed readily therefrom.

Figure 1:
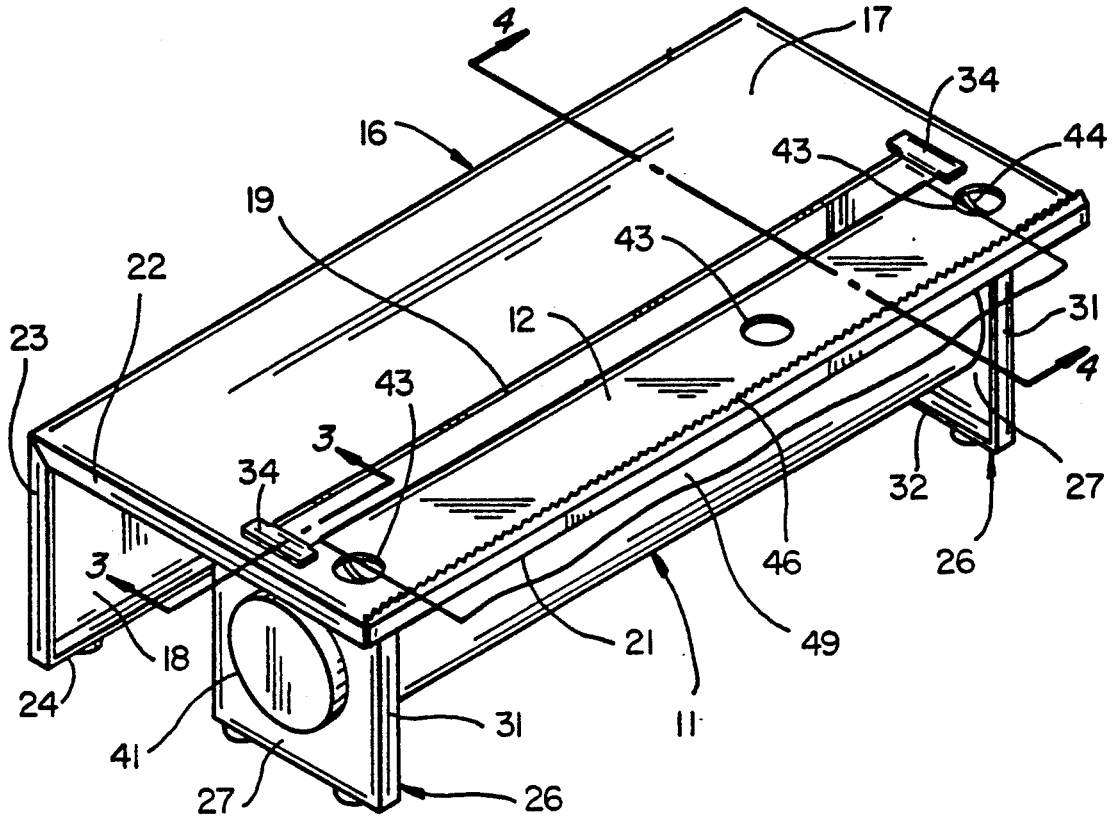
FIG. 1 is an isometric view of one embodiment of a wrapping table assembly according to the invention.
Figure 2:
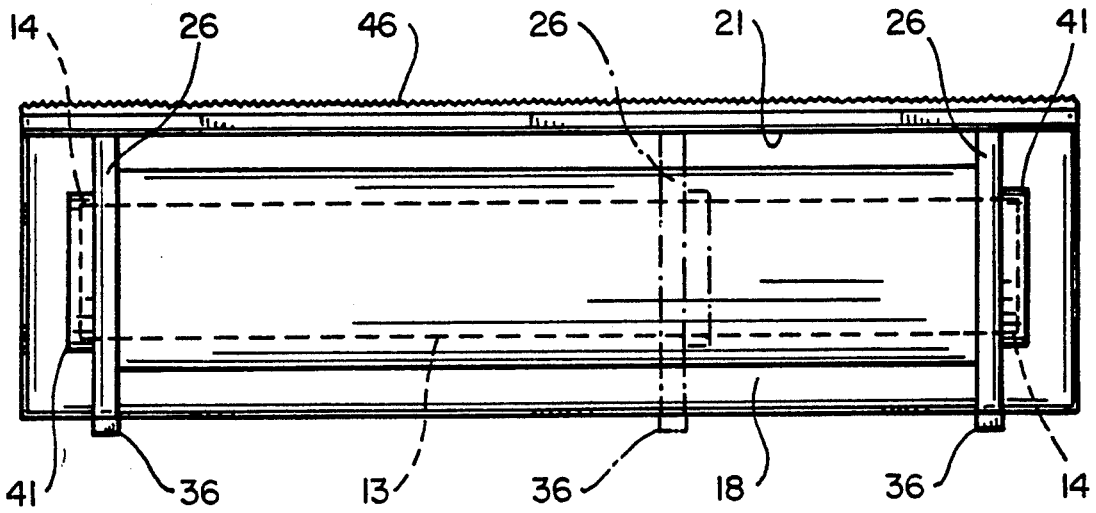
FIG. 2 is a front elevational view of the embodiment of FIG. 1.
Figure 3:
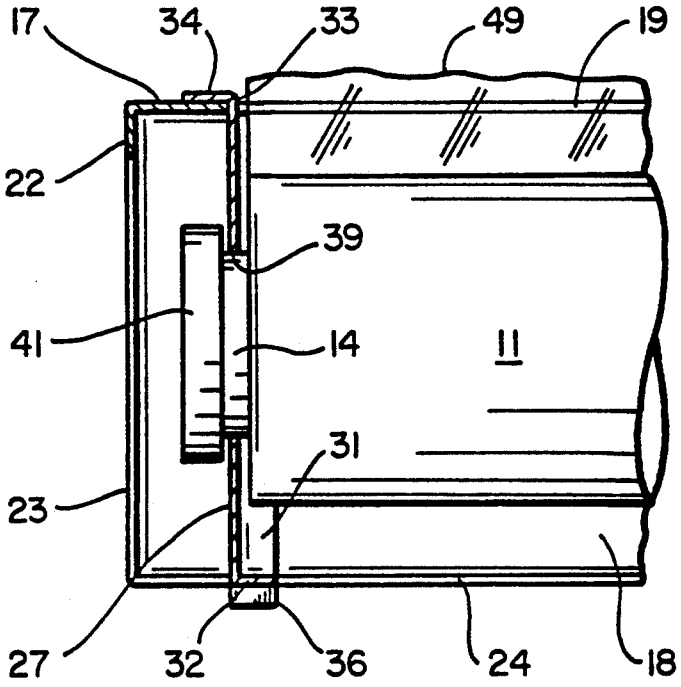
FIG. 3 is a cross-sectional view taken along line 3—3 in FIG. 1.
Figure 4:
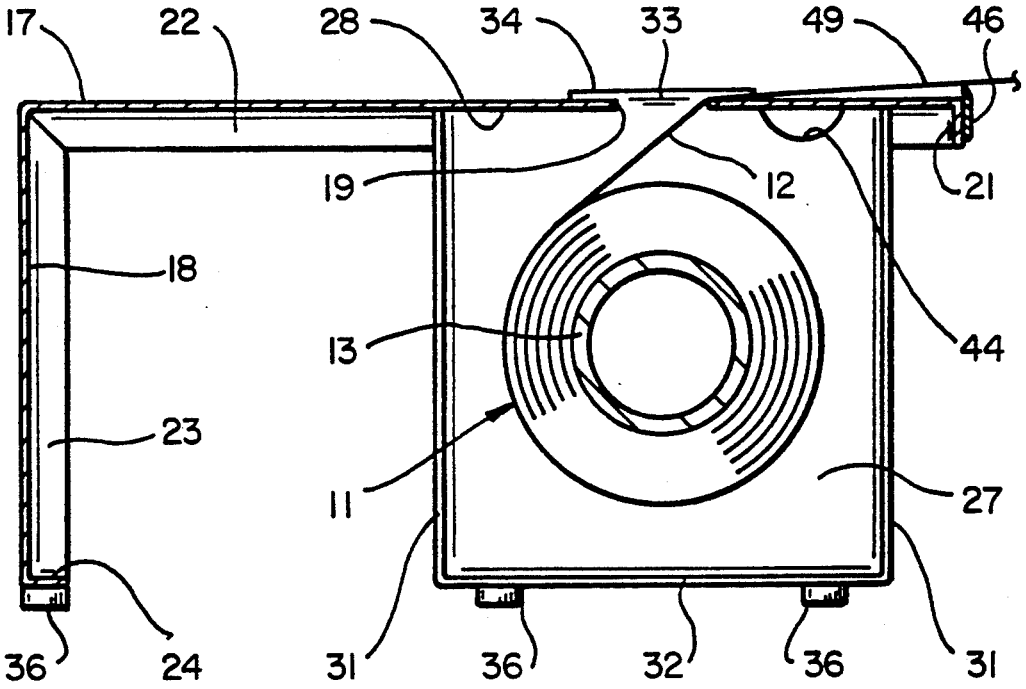
FIG. 4 is a cross-sectional view taken along line 4—4 in FIG. 1.

FIG. 2 illustrates the manner in which legs 27 can be positioned longitudinally of slotted opening 19 to accommodate rolls of different widths. In this figure, the legs are shown in full lines in position for holding a longer roll and in phantom lines in position for holding a narrower roll. In this particular embodiment, the left leg is in the same position for both rolls, and the right leg is moved toward the center of the table for the narrower roll.

A plurality of access openings 43 are provided in table top 17. These openings are located between slotted opening 19 and the front edge of the table top in positions corresponding to the positions of legs 26 for rolls of different widths. Corresponding openings 44 are provided in the upper portions of leg panels 27, and when the legs are in position to hold a roll of wrapping material, openings 44 are aligned with the corresponding openings 43.

A cutting blade 46 is mounted on flange 21 and extends along the front edge of table top 17 in a direction generally parallel to slotted opening 19 for cutting a length of wrapping material from roll 11 as it is wrapped about an object.

Operation and use of the wrapping table assembly is as follows. Legs 26 are installed on table member 16 as described above by inserting mounting tabs 33 through slotted opening 19 from the underside of table top 17 and turning the legs to bring flanges 34 into alignment crosswise of the opening. The roll of wrapping material is positioned between the legs, and one or both of the legs is adjusted lengthwise of the slotted opening so that the end portions 14 of the roll core extend through leg openings 39. End caps 41 are installed on end portions 14 to retain the roll and the legs in their relative axial positions. The free end 49 of the wrapping material is passed upwardly through opening 19 through the upper side of the table top where the objects are wrapped. The side edges of the wrapping material pass over openings 44 and are easily grasped even with a material such as plastic film which tends to cling to the table top.

Figure 5:
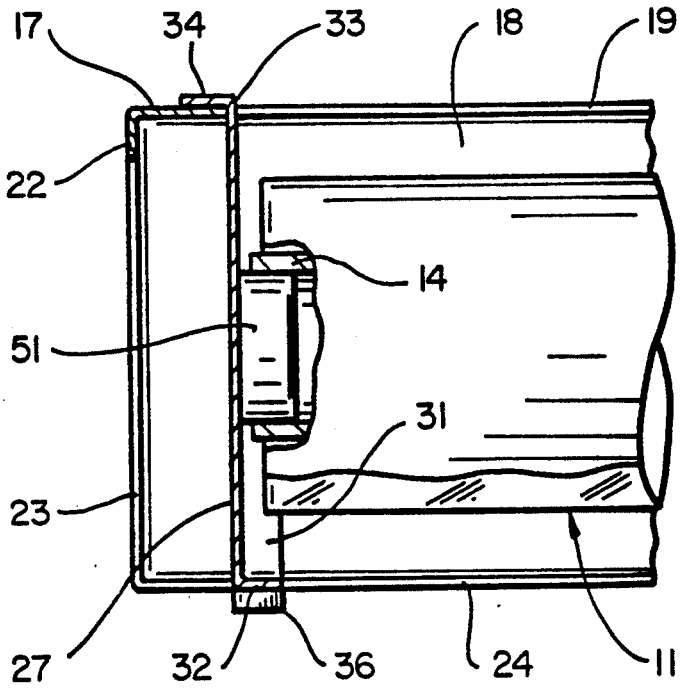
FIG. 5 is a cross-sectional view similar to FIG. 3 of a second embodiment of a wrapping table assembly according to the invention.
Figure 6:
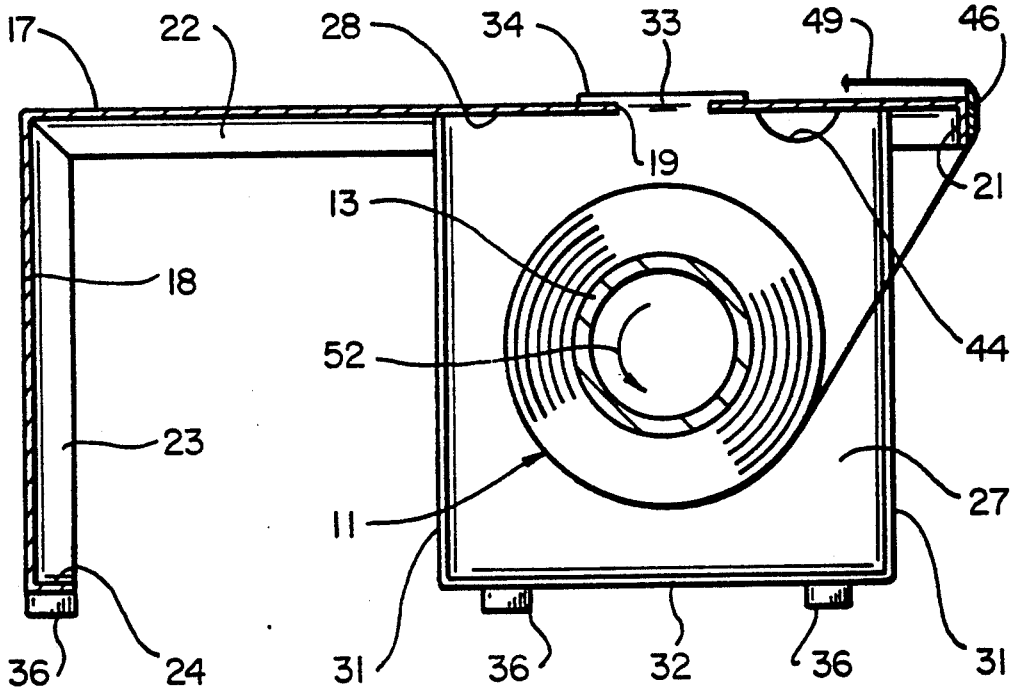
FIG. 6 is a cross-sectional view similar to FIG. 4 of the embodiment of FIG. 5.

The embodiment of FIGS. 5–6 is generally similar to the embodiment of FIGS. 1–4, and like reference numerals designate corresponding elements in the two embodiments. In the embodiment of FIGS. 5–6, the roll of wrapping material is rotatively mounted on hubs 51 which are carried by legs 26. The hubs comprise annular flanges which project inwardly from leg panels 27 and are rotatively received within the tubular core 14 of the wrapping material roll. The hubs are aligned on an axis below and generally parallel to slotted opening 19. The outside diameter of hubs 51 is slightly less than the inside diameter of core 14, and the hubs project a relatively short distance, e.g. one-half inch, into the core. In this embodiment, the roll is mounted on the hubs by separating the lower portions of legs 26, inserting the hubs into the ends of the core, and drawing the legs together again.

In the embodiment of FIGS. 5–6, the free end 49 of the wrapping material extends in an upward and forward direction from the lower side of the roll, around cutting blade 46 to the upper surface of table top 17. As the material is withdrawn from the roll, the roll rotates in the counterclockwise direction, as indicated by arrow 52 in FIG. 6. A wrapping material such as a plastic film tends to cling to the front face of the blade, producing an easier, cleaner cut than when the material is brought out through slot 19 and pulled downwardly across the blade to cut it.

Operation and use of the wrapping table assembly of FIGS. 5–6 is generally similar to the operation and use of the embodiment of FIGS. 1–4. In this embodiment, however, the wrapping material is brought out beneath the table top and pulled upwardly around cutting blade 46 and back across the upper side of the table top. The object to be wrapped can be placed either on or below the film on the upper surface of the table, then wrapped on the table top. The free end of the film is severed from the roll by pulling it back across the cutting edge of the blade. Once the cut has been made, the new free end of the film clings to the blade and remains in the position shown in FIG. 6. When another piece of film is desired, the reach between roll 11 and cutting blade 46 can be grasped at its edges and pulled up and around the cutting blade to the table top.

If desired, the wrapping material in the embodiment of FIGS. 1–4 can be brought out beneath the table top and around cutting blade 46 in the manner illustrated in FIG. 6. In order to do so, the only change required is to reverse the roll of material so that the free end extends in a forward direction from the lower side of the roll. Alternatively, the wrapping material can be brought out through slot 19 in the embodiment of FIGS. 5–6.

When the wrapping material is drawn up around the cutting blade in the manner illustrated in FIG. 6, the weight of the roll and the table is generally sufficient to hold the table down on the supporting surface. If additional stability is desired, suction cups can be utilized in place of the mounting feet 36 toward the front of the legs.

Figure 7:
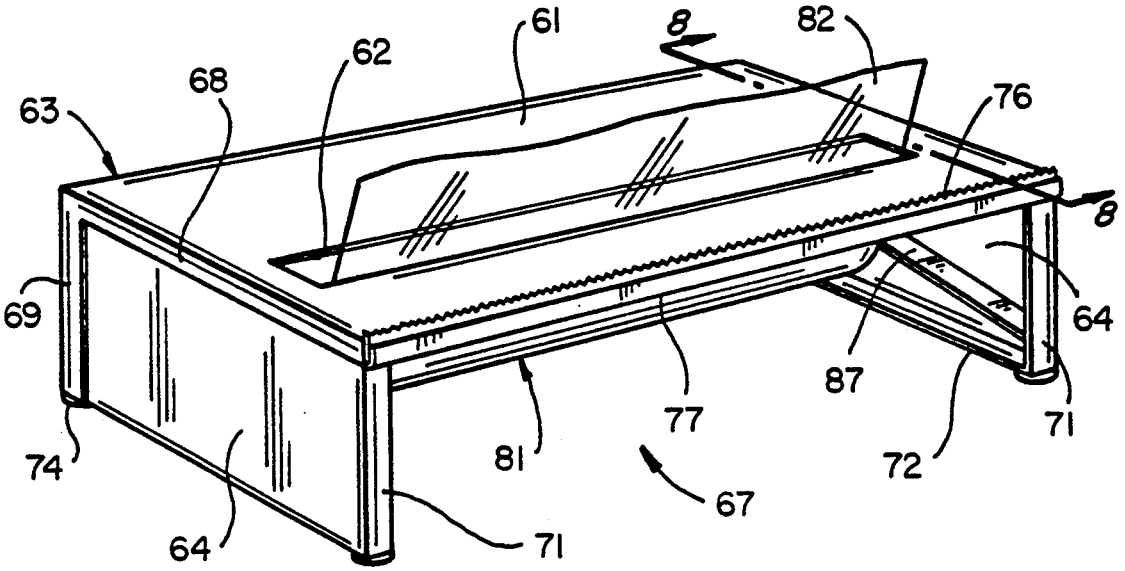
FIG. 7 is a perspective view of another embodiment of a wrapping table assembly according to the invention.
Figure 8:
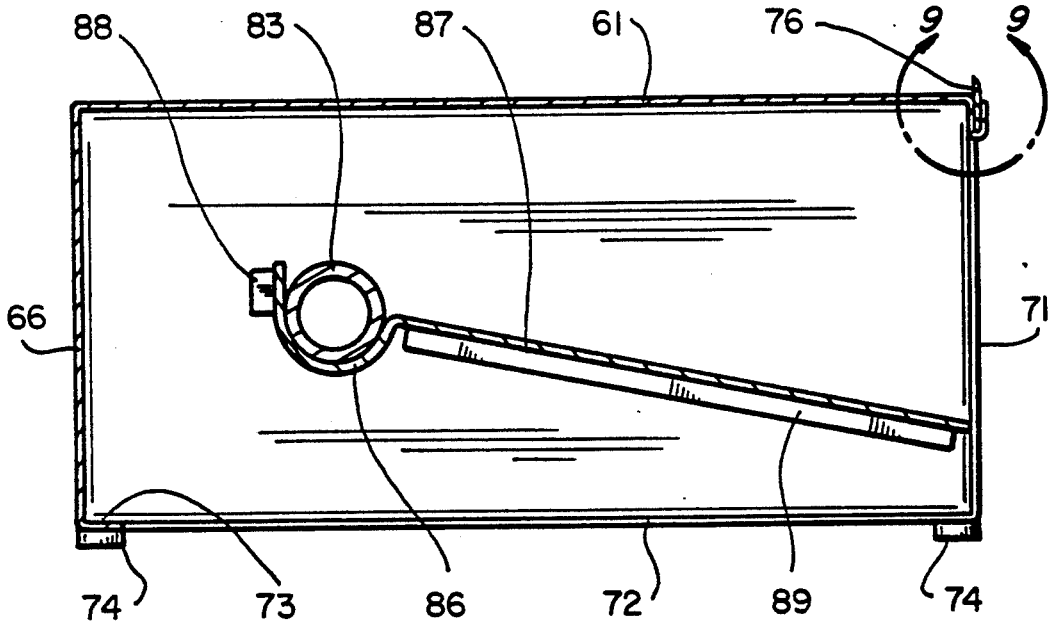
FIG. 8 is an enlarged sectional view taken along line 8—8 in FIG. 7.
Figure 9:
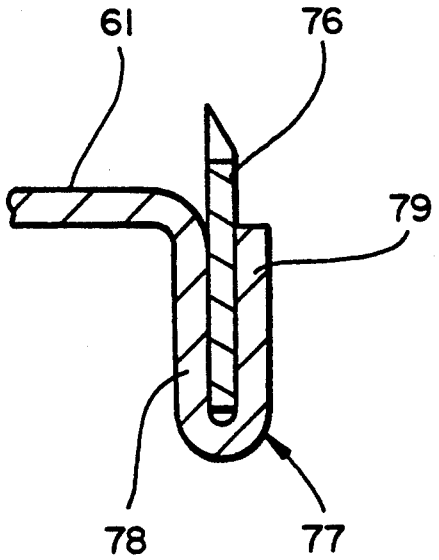
FIG. 9 is an enlarged fragmentary view of the region indicated by line 9—9 in FIG. 8.

In the embodiment of FIGS. 7–9, the wrapping table assembly has a generally rectangular table top 61 with an elongated slotted opening 62 generally parallel to the front and rear edges of the top. The table top is supported by a base 63 having side panels 64, a rear panel 66 and an open front 67. In the embodiment illustrated, table top 61 and rear panel 66 are formed as a single L-shaped member, and side panels 64 are formed separately and affixed to this member. Top wall 61 and rear panel 66 have flanges 68, 69 which overlap the top and rear margins of panels 64, flanges 71, 72 extend along the front and lower edges of the side panels, and a flange 73 extends along the lower edge of rear panel 66. Mounting feet 74 are provided at the four corners of the base.

A cutting blade 76 extends along the front edge of table top 61. As best seen in FIG. 9, a flange 77 of generally U-shaped cross-section extends along the front edge of the table top, and the cutting blade is clamped between the inner section 78 and the outer section 79 of this flange.

A roll of wrapping material 81 is rotatively mounted between side panels 64 beneath table top 61. The roll comprises an elongated sheet 82 of the wrapping material (e.g. plastic film) wrapped about a cylindrical core 83. The end portions of the cylindrical core project from the side edges of the rolled material and are rotatively received in semicircular journals 86 mounted on side panels 64. The upper sides of the journals are open, and the end portions of the core are inserted into and removed from the journals through these open sides. When the core is seated in the journals, the roll is held securely against the pull exerted on the roll as the material is drawn therefrom. Guides 87 extend between the journals and the open front of the base to facilitate installation of the roll of wrapping material. As best seen in FIG. 8, the guides are inclined upwardly and rearwardly from the front of the base to the open sides of the journals. The journals and the guides project horizontally inward from the side panels, with a width corresponding to the width of flanges 71. In the embodiment illustrated, each of the journals and its associated guide is fabricated as a unitary structure with mounting tabs 88, 89 for securing the structure to the side panel.

The table assembly of FIGS. 7–9 can be fabricated of any suitable material. In the embodiment illustrated, the table top, the side panels and the journal and guide members are fabricated of stainless steel, and they are joined together by spot welding.

Operation and use of the embodiment of FIGS. 7–9 is as follows. The roll of wrapping material is installed through the open front 67 of base 63, and the end portions of cylindrical core 83 are slid or rolled along guides 87 until they drop into journals 86. The free end of the wrapping material 82 is drawn in a forward direction from the lower side of the roll and passed in an upward direction through opening 62 in the table top. When the assembly is placed on a supporting surface, the base is essentially closed on all sides except the front, and being positioned toward the rear of this enclosure, the roll of wrapping material is substantially enclosed and protected from contamination.

The embodiment of FIGS. 10–12 is generally similar to the embodiment of FIGS. 7–9, and like reference numerals designate corresponding elements in the two embodiments. In the embodiment of FIGS. 10–12, however, table top 61, side panels 64 and rear panel 66 are fabricated as a unitary structure, e.g. by cutting the same from a sheet of stainless steel, bending the side and rear panels down along the side and rear edges of the table top, and securing the panels together at the rear corners of the base. In this embodiment, front flanges 71 are narrower than guides 87, and the front edges of the guides are set back a short distance from the front side of the base.

In the embodiment of FIGS. 10–12, slotted opening 62 is provided with a hinged flap or trap door 91. This flap comprises a generally rectangular member having a length slightly less than the length of the opening and a width slightly greater than the width of the opening. The flap is pivotally mounted in the opening by means of pins 92 which project longitudinally from the ends of the flap and are pivotally received in sockets 93 on the underside of the table top. The pins are positioned toward the rear of the flap, and the weight of the flap tends to hold it in a closed position with the front edge of the flap bearing down against the upper surface of the table top and the rear edge of the flap engaging the lower side of the table top. The flap serves as a closure for opening 62 and prevents contaminants such as particles from the object being wrapped from falling through the opening and contaminating the wrapping material. The wrapping material passes between the front edge of the flap and the table top, and the flap prevents the free end of the wrapping material from falling back through the opening. The front portion 94 of the flap is turned down slightly, as best seen in FIGS. 11 and 12, and the wrapping material is gripped between the lower front corner 96 of the flap and the table top. Since the front portion of the flap is free to pivot in an upward direction, the flap does not interfere with the passage of wrapping material through the opening as it is withdrawn from the roll.

Openings 97 are formed in the table top in front of slotted opening 62 to facilitate grasping the free end of wrapping materials such as plastic films which tend to cling to the table top. These openings provide areas in which the user can depress the material in order to grasp the same.

As illustrated in FIG. 13, the roll of wrapping material 81 is mounted on a spindle 98 which passes through core 83 and is rotatively received in journals 86. Rolls of different widths can be mounted on the spindle, and with rolls substantially narrower than the spacing between the journals, collars 99 are mounted on the spindle at the ends of the rolls to prevent undesired longitudinal movement of the rolls on the spindle. The collars have an axial bore 100 of approximately the same diameter as the spindle, and they are held in place on the spindle by friction.

Operation and use of the embodiment of FIGS. 10–12 is generally similar to the operation and use of the embodiment of FIGS. 7–9. In this embodiment, however, the free end of the wrapping material passes between the front edge of the trap door or flap 91 and the upper side of the table top, and the flap prevents the free end from falling back through the opening. The flap also closes the opening and prevents contaminants from falling onto the wrapping material below.

The embodiment illustrated in FIGS. 14–16 is generally similar to the embodiments of FIGS. 7–9 and 10–12. In this embodiment, the wrapping table includes a generally rectangular top 101 having an elongated slotted opening generally parallel to the front and rear edges of the top with a hinged flap or trap door 102 similar to trap door 91. The table top is supported by a base having side panels 104, a rear panel 106 and an open front 107. Flanges 108, 109 extend along the front and lower edges of the side panels, and a flange 111 extends along the lower edge of rear panel 106. Mounting feet 112 are provided at the four corners of the base. As in the embodiment of FIGS. 10–12, the table top, side panels and rear panel are fabricated as a unitary structure, and openings 113 are formed in the table top in front of the slotted opening to facilitate grasping the free end of the wrapping material.

Journal members mounted on side panels 104 rotatively support a roll of wrapping material beneath table top 101. The journal members include horizontally inclined rails 116 and vertically inclined stop members 117 near the lower ends of the inclined rails. The stop members are generally perpendicular to the inclined rails, and the stop members and rails form a corner into which the roll of wrapping material tends to roll. In FIG. 15, the end portion of the core 118 of a roll of wrapping material is shown resting on rail 116 and stop member 117. Alternatively, the roll can be mounted on a spindle received by rails 116 and stop members 117.

Guide rails 119 are also mounted on panels 104 to facilitate insertion of the roll of wrapping material and to prevent the roll from being pulled out of the journal members as the material is withdrawn from the roll. The guide rails extend upwardly and rearwardly from the front portion of the base in a direction generally parallel to rails 116. The rear portions of the guide rails extend beyond stop members 117 and over the lower end portions of rails 116.

A cutting blade 121 extends along the front edge of table top 101. This blade is clamped between the two sections of a flange 122 of generally U-shaped cross-section which extends along the front edge of the table top.

A blade guard 124 is movable between raised and lowered positions relative to cutting blade 121. The blade guard is carried by swing arms 126 which are pivotally mounted on side panels 104 by pivot pins 127.

Means is provided for yieldably urging the blade guard toward its raised or covering position. This means includes torsion springs 128 having coiled portions mounted on pivot pins 127, with spring arms 129, 131 engaging the undersides of table top and the swing arms. The force exerted by the springs is sufficient to hold the guard in its raised position with swing arms 126 abutting against flange 122 when the cutting blade is not in use. At the same time, the springs are yielding enough to permit the plastic film to move the guard away from the blade as it is pulled down across the blade, as indicated by phantom line 132 in FIG. 16.

Operation and use of the embodiment of FIGS. 14–16 is generally similar to the operation and use of the embodiment of FIGS. 10–12. The roll of wrapping material is inserted through the open front 107 of the base and slid or rolled along guide rails 119 until it drops off the rear ends of the guide rails onto inclined rails 116. The roll then moves forward until it abuts against stops 117. The free end of the film material is withdrawn from the roll and passed through the slotted opening in the table top where it is held by flap 102. As the film material is withdrawn from the roll in an upward direction, the overhanging rear end portions of guide rails 119 prevent the roll from being pulled away from the journal members.

Blade guard 124 is normally in the raised position where it covers cutting blade 121. When the plastic film material is pulled in a downward direction across the blade, the guard swings down, exposing the blade to cut the film.

The embodiment of FIGS. 17–18 is generally similar to the embodiment of FIGS. 14–16, and like reference numerals designate corresponding elements in the two embodiments.

The embodiment of FIGS. 17–18 is adapted for use with rolls of different widths without the need for a spindle on which the different rolls can be mounted. This embodiment includes a pair of brackets 136 which are mounted on the side panels 104 on opposite sides of the base for receiving and retaining rolls of different widths. While only one of the brackets is shown for ease of illustration, the other bracket is a mirror image of the one which is shown.

In the embodiment illustrated, brackets 136 are unitary structures fabricated of sheet metal and affixed to side panels 104 by suitable means such as spot welding. Each of the brackets has a horizontally inclined upper flange 137 which upwardly and rearwardly from a position near the open front side of the base. Each of the brackets also has a lower flange 138 which is parallel to flange 137 and spaced from it by a distance corresponding to the core diameter of the narrower of the rolls to be supported by the brackets. A third flange 139 is positioned between the first two flanges and spaced from lower flange by a distance corresponding to the core diameter of the wider roll to be supported by the brackets. Flange 139 is narrower than the other two flanges, and the distance between the inner edges of the flanges 139 on opposite sides of the base is slightly greater than the length of the core of the narrower roll. Flange 139 extends somewhat farther toward the rear of the base than flange 137, and flange 138 extends farther toward the rear than flange 139. A vertically inclined flange 141 extends in an upward and forward direction between positions near the forward end of flanges 138 and 139. The width of flange 141 is similar to the that of flanges 137, 138. Flange 141 is generally perpendicular to the horizontally inclined flanges, and in the embodiment illustrated, the horizontally inclined flanges are inclined at an angle on the order of 17.5 degrees relative to the horizontal.

Operation and use of the embodiment of FIGS. 17–18 is generally similar to that of the embodiment of FIGS. 14–16. Flanges 137 serve as guide rails for inserting a roll of wrapping material. As in the embodiment of FIGS. 14–16, the roll is inserted through the open front of the base and rolled or slid along flanges 137 until it drops off the rear ends of these flanges onto the lower flanges 138. The roll then rolls forward until the core abuts against vertically inclined flanges 141 which serve as stops for the roll. As the roll moves forward, the outer ends of the core move beneath flange 139 or the rear portion of flange 137, depending upon the length of the core, i.e. the width of the roll. These flanges prevent the roll from being pulled away from the journals formed by flanges 138, 141 as the film material is withdrawn from the roll.

In the drawings, two rolls of different widths are shown in phantom lines. A wider roll 143 has a longer core 144 of smaller diameter which is retained by flanges 139, and a narrower roll 146 has a shorter core 147 of greater diameter which is retained by flanges 137. The length of core 147 is less than the distance between the inner edges of flanges 139 so that these flanges do not interfere with the insertion and rotation of the narrower roll. If desired, the rolls can be placed on spindles which are received by the flanges in place of the cores. In this case, one of the spindles would have a greater length and a smaller diameter for retention by flanges 139, and the other spindle would have a shorter length and a larger diameter for retention by Flanges 137. As in the case of the narrower core, the shorter spindle would have a length less than the distance between the inner edges of flanges 139 so that it can pass freely between these flanges.

The embodiment of FIG. 19 is similar to the embodiment of FIGS. 17–18. In this embodiment, however, the flanges which support and retain the rolls of film material are formed integrally with the side panels, rather than being formed by brackets attached to the side panels. In this regard, portions of the side panels 151 are cut out and bent in an inward direction to form flanges 152–155 which correspond to flanges 137, 138, 139 and 141, respectively. As is the case with flange 139, flanges 154 are not as wide as the other flanges, and the core or spindle which supports the narrower roll passes freely between these flanges.

The embodiment of FIG. 19 also has a blade guard 157 which is generally similar to blade guard 124. However, blade guard 157 has a surface contour such that the film material can slide across the guard without adhering to it. This is important in that it prevents the guard from hanging up as the film material is drawn across it in a downward direction to expose the blade. If the film material were to stick to the guard and to the teeth of the partially exposed blade, the film material could prevent further movement of the guard away from the blade, which would prevent the blade from becoming fully exposed and cutting the film material.

As illustrated in FIG. 19, the upper portion of blade guard 157 is bent back to form a narrow flange or lip 158, with a rounded corner 159 extending along the front edge of the flange or lip. As the film material is drawn across the guard, it engages the flange and the rounded corner, and the contour of the flange and the rounded corner permit the film material to slide over the guard without catching so that the guard moves freely to its retracted position, exposing the blade 161.

Blade guard 157 is mounted on a pair of swing arms 162 which are pivotally mounted on side panels 151 by pivot pins 163. Torsion springs 164 are also mounted on the pivot pins, with spring arms 166, 167 engaging the undersides of the table top 169 and the swing arms. The springs are retained on the pins by E-rings 171.

As in the other embodiments, the embodiment of FIG. 19 has an elongated slotted opening 172 in the table top, through which the free end of the film material passes. A pivotally mounted trap door 173 covers the opening and prevents the free end of the film material from falling back through the opening. Also as in the other embodiments, a pair of access openings 174 are provided in the table top to facilitate gripping of the edge portions of the film material.

The invention has a number of important features and advantages. It provides a wrapping table for use with unboxed rolls of wrapping material. The assembly is self-supporting and can be adjusted to accommodate rolls of different widths. The assembly is portable and can be readily set up for use.

It is apparent from the foregoing that a new and improved wrapping table assembly has been provided. While only one presently preferred embodiment has been described in detail, as will be apparent to those familiar with the art, certain changes and modifications can be made without departing from the scope of the invention as defined by the following claims.

I claim:

1. In a wrapping table for use with a roll of plastic film wrapping material: a table top for receiving objects to be wrapped, a base for supporting the table top above a supporting surface, journal members engageable with end portions of the roll of wrapping material for rotatively supporting the roll below the table top so that the film material can be withdrawn from the roll and used for wrapping objects on the table top, the roll itself being positioned entirely below the table top so that the roll does not interfere with the wrapping of objects on the table top, guide members engageable with the end portions of the roll and overlying the journal members for guiding the roll to the journal members and preventing the roll from being pulled out of the journal members as the film material is withdrawn from the roll, a cutting blade extending along one edge of the table top, a blade guard movable between covering and retracted positions relative to the cutting blade, and means yieldably urging the blade guard toward the covering position with a force which can be overcome by pulling the film material against the guard to expose the blade.

2. The wrapping table of claim 1 wherein the guide members comprise rails on which the roll can be rolled toward the journal members, said guide rails having end portions which extend over portions of the journal members, and the journal members are inclined in such manner that the roll of wrapping material tends to roll beneath the end portions of the guide rails when supported by the journal members.

3. The wrapping table of claim 2 wherein the journal members include inclined rails extending below the end portions of the guide rails for receiving the end portions of the roll and stops near the inclined rails for engagement with the end portions of the roll on the inclined rails.

4. The wrapping table of claim 3 wherein the guide rails are inclined in a direction generally parallel to the journal rails.

5. The wrapping table of claim 1 wherein the blade guard is carried by pivotally mounted arms, and the means for urging the blade guard toward the covering position includes springs connected to the arms.

6. The wrapping table of claim 5 wherein the pivot arms are pivotally mounted on the base by pivot pins located near the ends of the arms, and the springs comprise torsion springs having coil portions mounted over the pivot pins and arm portions which engage the table top and the pivot arms to urge the pivot arms in an upward direction.

7. In a wrapping table for use with a roll of plastic film material: a table top having an elongated opening, means for rotatively supporting the roll below the table top with a free end of the material extending through the elongated opening to the upper side of the table top, a blade extending along one edge of the table top for cutting the film material, a pair of access openings, in the table top positioned between the elongated opening and the cutting blade and extending beneath and laterally beyond the marginal edge portions of the film material to facilitate grasping of the film material, a blade guard movable between a raised position in which the blade is covered by the guard and a lowered position in which the blade is exposed, means yieldably urging the blade guard in an upward direction toward the raised position with a force which can be overcome by pulling the film material in a downward direction over the blade guard, and a curved upper surface on the blade guard for engaging the film material and permitting the film material to slide across the same without adhering as the film material is pulled in the downward direction.

8. The wrapping table of claim 7 wherein the access openings are elongated and generally parallel to the opening through which the film material passes and to the blade.

9. In a wrapping table for use with a roll of plastic film wrapping material: a table top for receiving objects to be wrapped, means for rotatively supporting the roll below the table top so that the film material can be withdrawn from the roll and used for wrapping objects on the table top, a cutting blade extending along one edge of the table top, a blade guard mounted on a pair of pivotally mounted swing arms for movement between covering and retracted positions relative to the cutting blade and having a surface contour such that the film material can slide across the guard without adhering thereto, and means yieldably urging the blade guard toward the covering position with a force which can be overcome by pulling the film material against the guard to expose the blade, said blade guard having a curved upper surface which is engaged by the film material as the film material is pulled in a downward direction over the blade guard.

10. The wrapping table of claim 9 wherein the means yieldably urging the blade guard comprises torsion springs having arm portions which engage the undersides of the table top and the swing arms to urge the blade guard in an upward direction.

11. In a wrapping table for use with a roll of plastic film wrapping material: a table top for receiving objects to be wrapped, means for rotatively supporting the roll in proximity to the table top so that the film material can be withdrawn from the roll and used for wrapping objects on the table top, a blade extending along one edge of the table top for cutting the film material when the material is drawn in a downward direction across the blade, a blade guard movable between a raised position in which the blade is covered by the guard and a lowered position in which the blade is exposed, means yieldably urging the blade guard in an upward direction toward the raised position with a force which can be overcome by pulling the film material in a downward direction over the blade guard, and a curved upper surface on the blade guard for engaging the film material and permitting the film material to slide across the same without adhering as the film material is pulled in the downward direction.

12. In a wrapping table for use with first and second rolls of plastic film wrapping material of different widths: a table top for receiving objects to be wrapped, a single pair of journal members engageable with end portions of the first and second rolls of wrapping material for rotatively supporting either one of the rolls below the table top so that the film material can be withdrawn from the roll and used for wrapping objects on the table top, a first pair of retainers overlying the single pair of journal members for engagement with the end portions of a wider roll to prevent the wider roll from being pulled out of the journal members as the film material is withdrawn from the wider roll, and a second pair of retainers overlying the single pair of journal members for engagement with the end portions of a narrower roll to prevent the narrower roll from being pulled out of the journal members as the film material is withdrawn from the narrower roll, the end portions of the narrower roll being free to pass between the first pair of retainers.

13. The wrapping table of claim 12 wherein one of the rolls of wrapping material comprises a length of material wrapped about an axis, with a central opening extending axially through the roll, and a spindle extending through the opening for engagement with the journal members.

14. In a wrapping table for use with a roll of plastic film material: a generally rectangular table top having an elongated slotted opening extending in a direction generally parallel to one edge of the table top, a spindle rotatively mounted beneath the table top and extending substantially the entire length of the slotted opening for supporting rolls of different widths of the film material below the table top with a free end of the material extending through the slotted opening and along the upper side of the table top to the one edge, a blade extending along the one edge for cutting the film material, and a pair of access openings in the table top between the slotted opening and the cutting blade of sufficient dimension to underlie the marginal edge portions of the film material from rolls of different widths with portions of the openings extending beyond the edge portions of the film material to facilitate grasping of the film material.

15. The wrapping table assembly of claim 14 including a blade guard movable between a raised position in which the blade is covered by the guard and a lowered position in which the blade is exposed, means yieldably urging the blade guard in an upward direction toward the raised position with a force which can be overcome by pulling the film material in a downward direction over the blade guard, and a curved upper surface on the blade guard for engaging the film material and permitting the film material to slide across the same without adhering as the film material is pulled in the downward direction.

16. In a wrapping table for use with first and second rolls of plastic film wrapping material of different widths: a table top for receiving objects to be wrapped, journal members engageable with end portions of the rolls of wrapping material for rotatively supporting either one of the rolls below the table top so that the film material can be withdrawn from the roll and used for wrapping objects on the table top, a first pair of retainers overlying the journal members for engagement with the end portions of a wider roll to prevent the wider roll from being pulled out of the journal members as the film material is withdrawn from the wider roll, and a second pair of retainers positioned above and wider than the first pair of retainers for engagement with the end portions of a narrower roll to prevent the narrower roll from being pulled out of the journal members as the film material is withdrawn from the narrower roll, the end portions of the narrower roll being free to pass between the first pair of retainers.

17. The wrapping table of claim 16 including means for holding the wrapping material in a predetermined position on the spindle.

18. In a wrapping table for use with a roll of plastic film wrapping material: a table to for receiving objects to be wrapped, means for rotatively supporting the roll below the table top so that the film material can be withdrawn from the roll and used for wrapping objects on the table top, a cutting blade extending along one edge of the table top, a blade guard movable between covering and retracted positions relative to the cutting blade, and means yieldably urging the blade guard toward the covering position with a force which can be overcome by pulling the film material against the guard to expose the blade, said blade guard having a vertically extending main portion generally parallel to the blade, a relatively narrow flange extending along the upper margin of the main portion, and a rounded corner between the main portion and the flange, said rounded corner cooperating with the flange to provide a surface across which the film material can slide without adhering thereto as it is pulled against the guard.

* * * * *